United States Patent [19]

Bauerle et al.

[11] Patent Number: 4,682,489

[45] Date of Patent: Jul. 28, 1987

[54] PROCESS FOR INCREASING THE FATIGUE STRENGTH OF COMPONENTS WITH DIFFERENT SHAPES OR DESIGNS

[76] Inventors: Hans Bauerle, Spitzwegstr. 13; Hansgeorg Peste, Am Schimmelberg 55, both of D-7080 Aalen 1; Erwin Pohlner, Ahornweg 2, D-7099 Adelmannsfelden, all of Fed. Rep. of Germany

[21] Appl. No.: 797,232

[22] Filed: Nov. 12, 1985

[51] Int. Cl.[4] ..... B21K 1/08

[52] U.S. Cl. ..... 72/460; 29/6; 72/76; 72/465

[58] Field of Search ..... 29/6, 90 A; 72/53, 76, 72/110, 412, 460, 465; 30/361, 367

[56] References Cited

U.S. PATENT DOCUMENTS

| | | | |
|---|---|---|---|
| 1,374,877 | 4/1921 | Carlson | 72/421 |
| 1,385,268 | 7/1921 | Paulson | 72/460 |
| 2,841,861 | 7/1958 | Williams | 29/6 |
| 2,888,846 | 6/1959 | Peras | 29/6 |
| 4,416,130 | 11/1983 | Judge, Jr. | 72/76 |

*Primary Examiner*—Lowell A. Larson
*Attorney, Agent, or Firm*—Olson and Olson

[57] ABSTRACT

The fatigue strength of high stress areas of components of diverse shapes is increased by cold forming by clamping the component resiliently between a base and a clamp member urged resiliently toward the base, and impacting the component area with a complementary shaped reciprocative snap die driven by a percussion piston. Two diverging dies may be driven by the same percussion piston to impact two spaced component areas such as opposed fillets of a crankshaft throw.

5 Claims, 3 Drawing Figures

1
2
3
4
5
6
7
8
9
A

PROCESS FOR INCREASING THE FATIGUE STRENGTH OF COMPONENTS WITH DIFFERENT SHAPES OR DESIGNS

BACKGROUND OF THE INVENTION

The present invention relates to a process and to an apparatus for increasing the fatigue strength or durability of components having different shapes and sizes, particularly large crankshafts by cold forming, such as hammering, in the highest stressed areas at section changes, such as at fillets and bore openings.

Increasing the fatigue strength of components in the highest stressed areas at section changes by cold forming, such as hammering is a known process, which is applied in different ways. However, usually forces are introduced into the components by means of commercially available striking tools, such as pneumatic hammers and hydraulic vibrators. The pneumatic hammer is mainly used manually, in such a way that with an estimated distance blows are given and these strike the component in unequal spacings and impact directions. It is clear that this process cannot lead to the maximum theoretically and empirically achievable fatigue strength as a result of the imprecision in the level of the force action, as well as in the spacing of such actions and consequently a necessary surface quality for avoiding reworking. The use of hydraulic vibrators, whose application is described in the journals Vestnik Masinostroenija 49/1969, pp 58–59 and Traktory i sel schozmasiny 10/1969, pp 41–42, requires a continuous turning of the same when working round components, so that it is not possible to obtain a heightwise and adequately accurately determinable impact spacing for avoiding reworking and achieving the maximum fatigue strength in the hammered area.

SUMMARY OF THE INVENTION

According to the invention this problem is solved in that the impact force and impact spacing are so matched to one another that the maximum possible fatigue strength increase is achieved and the resulting surface quality of the hammered surface makes it unnecessary to rework the same for avoiding notch effects.

BRIEF DESCRIPTION OF THE DRAWINGS

The invention is described in greater detail hereinafter relative to a non-limitative preferred embodiment applied to a large crankshaft and the attached drawings, wherein show.

DESCRIPTION OF THE PREFERRED EMBODIMENT

Figure 1:
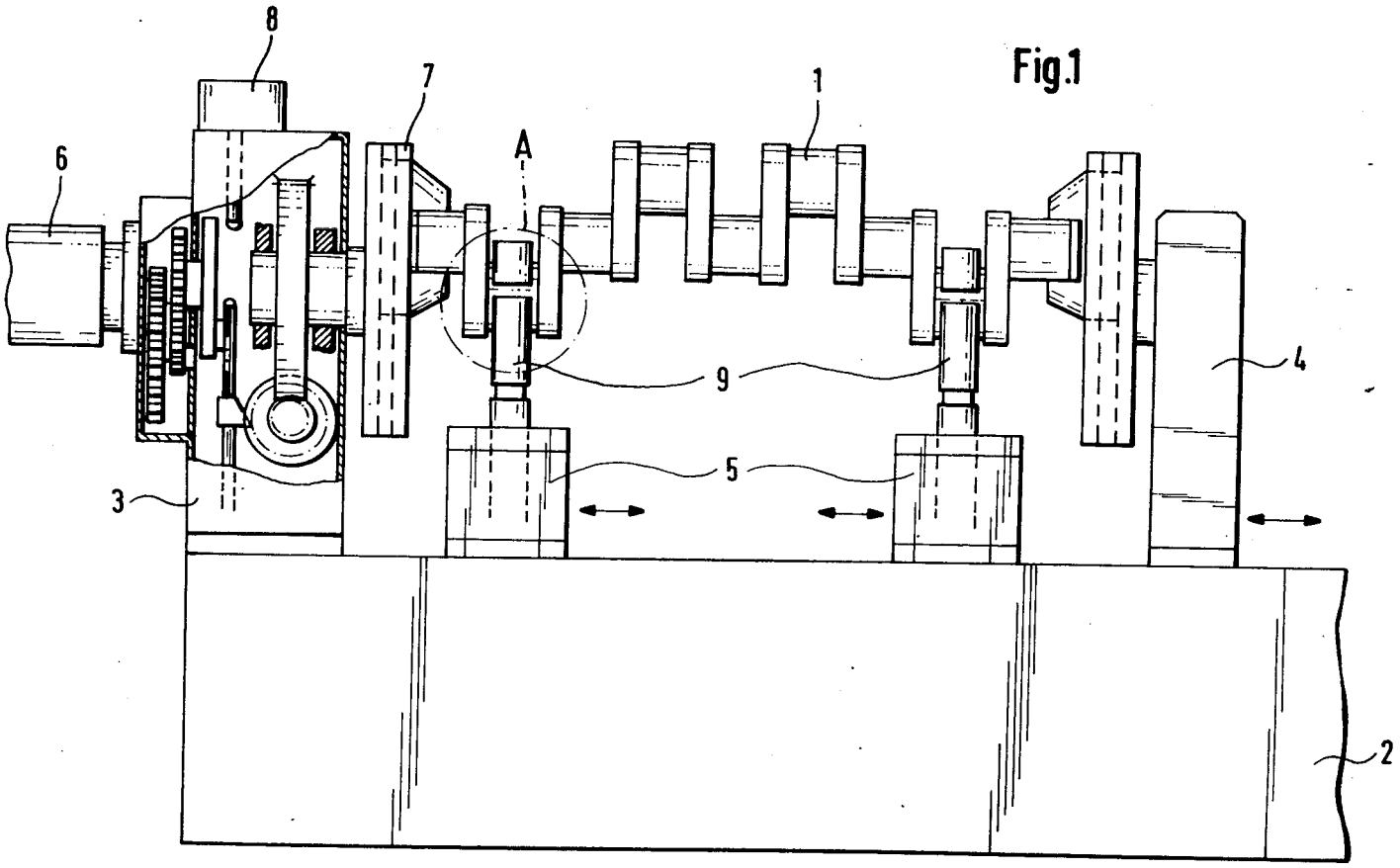
FIG. 1 An overall view of the apparatus.
Figure 2:
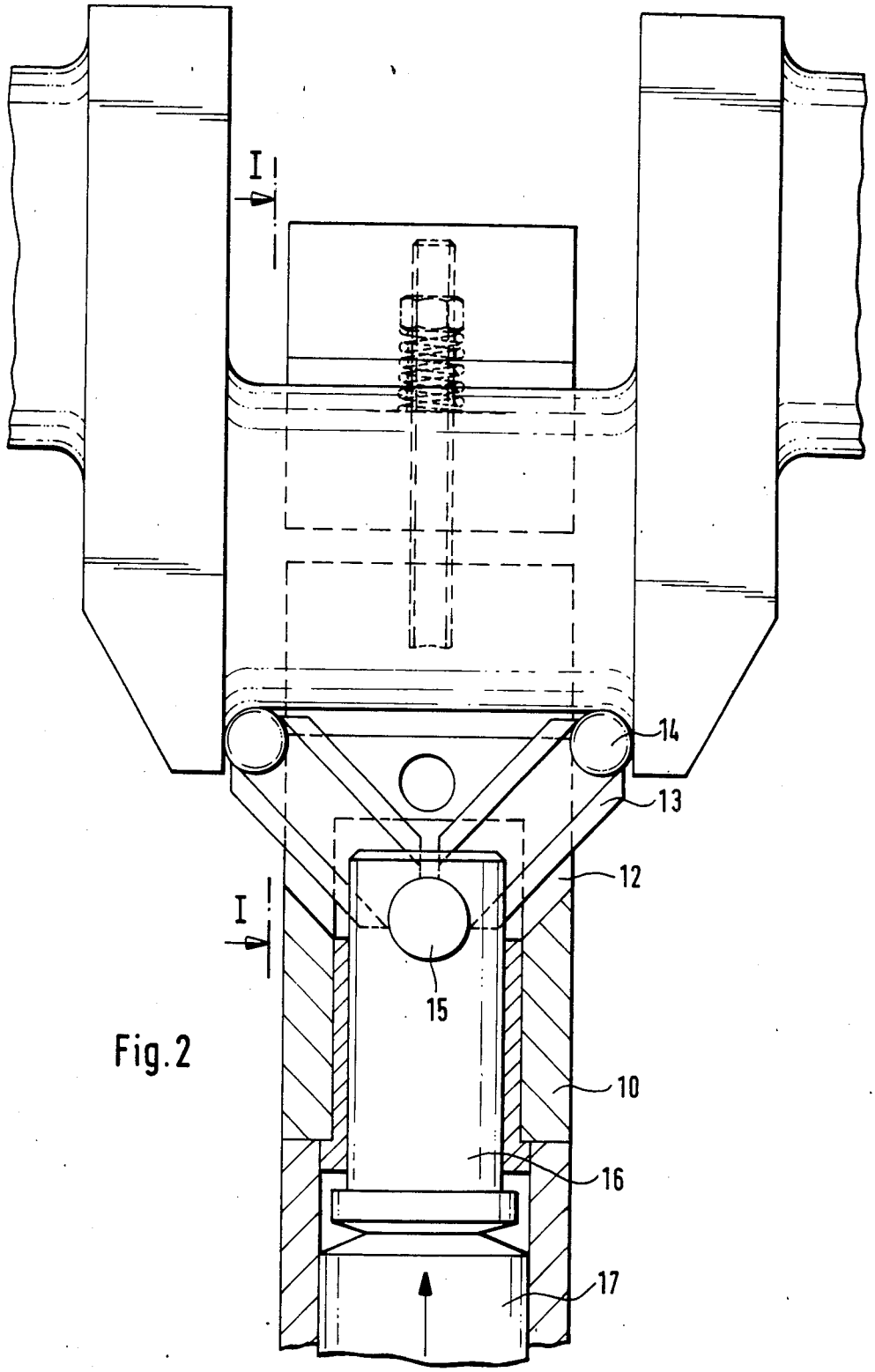
FIG. 2 Detail 'A'.
Figure 3:
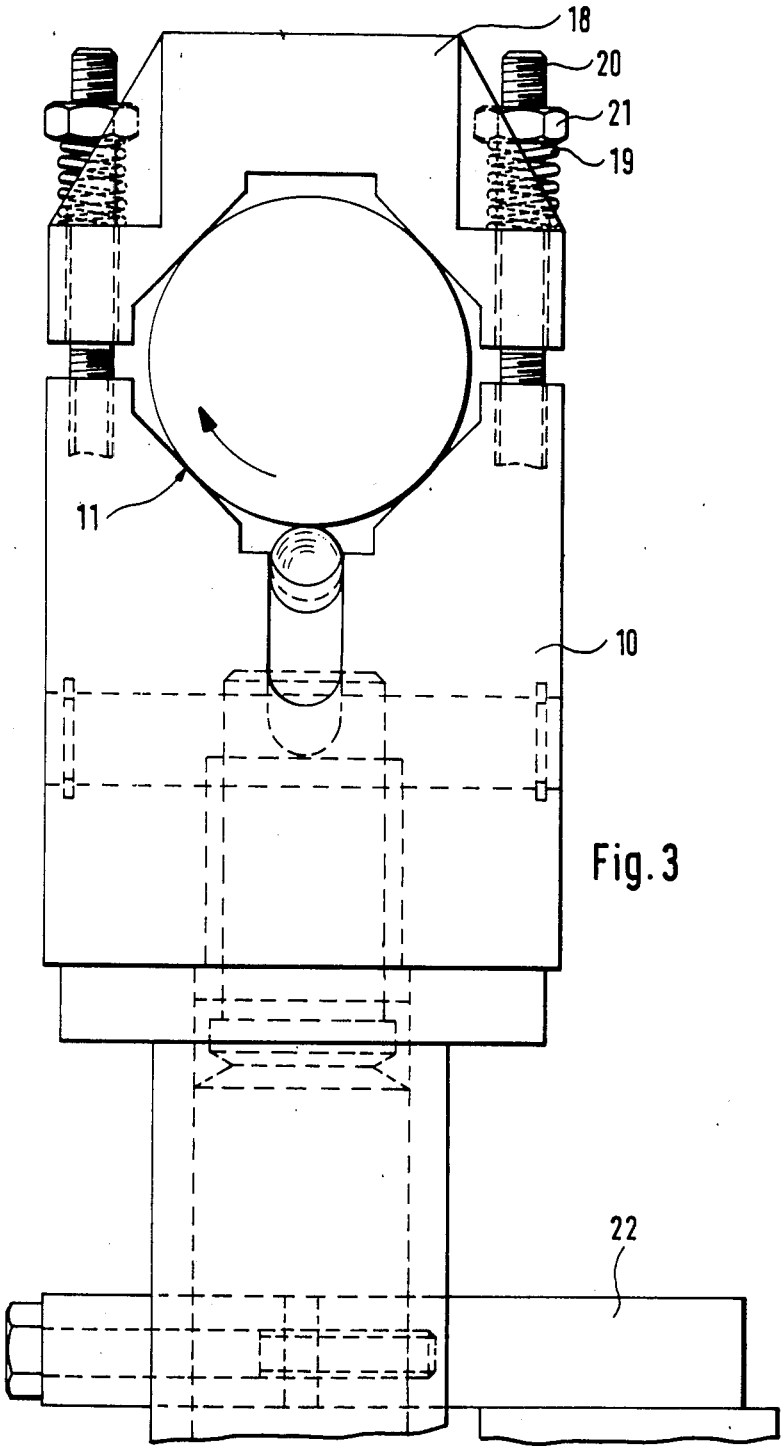
FIG. 3 Section I—I of FIG. 2.

As is shown in FIG. 1, an apparatus for performing the process according to the invention comprises a base 2, a gearbox 3, a support 4 and several striking means 9. Support 4 and striking means 9 are longitudinally displaceable to permit an adaptation to the particular component 1. The details thereof can be assumed as known and will consequently not be described in detail here. Gearbox 3 contains devices, which from a drive 6 bring about a regulatable, intermittent further rotation of the tightening disc 7 and at the end thereof and by means of a device 8 initiate an intensity-regulatable impact of the striking means 9. Such means are known from other uses and are in part commercially available, so that there is no need for a more detailed description thereof. The striking means 9 referred to hereinafter comprises a basic member 10, which is provided with a prismatic bearing surface 11 corresponding to the radius of the workpiece to be worked and has guides 12, which guide two snap dies 13 in their support plane and in the support angle about bolt 15 give them the freedom necessary for adapting to the dimensional conditions of component 1.

Bolt 15 transfers the impact energy to the snap dies 13 and is therefore located in a somewhat larger bore to permit the penetration of dies 13 into component 1. An intermediate part 16 represents the connection between percussion piston 17 and bolt 15, which transfers the impact energy to the snap dies 13. For increasing the effectiveness of the blow or impact, a clamping prism 18 is fixed by means of springs 19 with adjustable clamping bolts 20, 21 to the opposite side of basic member 10. For determining its position with respect to component 1, striking means 9 is adjustably held in a clamping device 22. This arrangement of several impact means make it possible to simultaneously work all the centrally moving areas. As practice has shown, for rotating component 1 to obtain the impact spacing, it is not necessary to release the clamping of the prismatic mount of parts 10 and 18. The necessary mobility is ensured by a single lubrication with commercially available greases. The description represents one application of the process of the invention, namely the working of two areas simultaneously, which is particularly economic in this case. It is also possible and can be achieved with similar means to work with only a single snap die 13, but it would then appear necessary to have an inclined position of the striking means 9 whilst providing a matching means as a substitute for the second snap die 13 for absorbing the uncompensated opposing forces. In the same way apparatus modifications are conceivable, which permit working on linear and flat components in accordance with the aforementioned process.

What is claimed is:

1. Apparatus for increasing the fatigue strength of components, comprising:

(a) a base supporting a basic member, (b) a bearing surface on the basic member for supporting a component, (c) a clamp member mounted on and spaced from the basic member for interposing a component between them, (d) resilient connector means interconnecting the basic member and clamp member for urging the clamp member resiliently toward the basic member for clamping a component therebetween, (e) snap die means on the basic member movable toward and away from a clamped component for cold forming the latter, and (f) percussion drive means on the base engaging the snap die means for moving the latter to impact a component to be cold formed thereby.

2. The apparatus of claim 1 for cold forming a pair of laterally spaced fillets of a crankshaft, wherein the snap die means comprises a pair of snap dies , and guides on the basic member support the pair of snap dies in a laterally outwardly diverging configuration, the diverging ends arranged to engage the pair of fillets and the converging ends arranged for operative engagement by the percussion drive means.

3. The apparatus of claim 1 wherein the resilient connector means comprises bolts on the basic member engaging the clamp member, and spring means interengaging the bolts and clamp member for urging the latter resiliently toward the basic member.

4. Apparatus for increasing the fatigue strength of a pair of laterally spaced fillets of each of a plurality of crankshaft throws by cold forming the fillets, comprising:

(a) a base supporting a plurality of basic members, (b) a bearing surface on each basic member for supporting a crankshaft throw.

(c) a clamp member mounted on and spaced from each basic member for interposing the crankshaft throw between them, (d) resilient connector means interconnecting each basic member and clamp member for urging the clamp member resiliently toward the basic member for clamping the crankshaft throw therebetween, (e) a pair of snap dies for each basic member, (f) guides on each basic member supporting the pair of snap dies in a laterally outwardly diverging configuration, the diverging ends arranged to engage the pair of fillets, the snap dies having impacting surfaces complementing the contour of the fillets to be cold formed, and (g) percussion drive means on the base associated with each basic member and engaging the converging ends of the associated snap dies for moving the latter to impact the fillets to be cold formed thereby.

5. The apparatus of claim 4 wherein the plurality of basic members are adjustable along the base for registration of the basic members with the crankshaft throws.

* * * * *

UNITED STATES PATENT AND TRADEMARK OFFICE

CERTIFICATE OF CORRECTION

PATENT NO. : 4,682,489

DATED : 28 July 1987

INVENTOR(S) : Hans Bauerle et al

It is certified that error appears in the above-identified patent and that said Letters Patent are hereby corrected as shown below:

Column 3, line 2, after "basic member" insert -- slidably --.

Signed and Sealed this

Twenty-fourth Day of November, 1987

*Attest:*

DONALD J. QUIGG

*Attesting Officer*

*Commissioner of Patents and Trademarks*